US006641389B1

(12) United States Patent
Huang

(10) Patent No.: US 6,641,389 B1
(45) Date of Patent: Nov. 4, 2003

(54) LIGHTER HAVING A SAFETY SWITCH

(76) Inventor: Ying Fang Huang, No. 2, Lane 22, Sec. 2, Shanshi Rd., Bei Chiu, Taichung (TW)

( * ) Notice: Subject to any disclaimer, the term of this patent is extended or adjusted under 35 U.S.C. 154(b) by 0 days.

(21) Appl. No.: 10/279,794

(22) Filed: Oct. 25, 2002

Related U.S. Application Data

(63) Continuation-in-part of application No. 10/139,258, filed on May 7, 2002, now Pat. No. 6,551,097.

(51) Int. Cl.[7] ..... F23Q 2/28

(52) U.S. Cl. ..... 431/153; 431/129; 431/132; 431/255

(58) Field of Search ..... 431/129–141, 431/153, 255, 257

(56) References Cited

U.S. PATENT DOCUMENTS 5,662,466 A * 9/1997 Cheng ..... 431/255
6,039,561 A * 3/2000 Lei ..... 431/255
6,135,761 A * 10/2000 Chen ..... 431/132
6,186,772 B1 * 2/2001 Huang ..... 431/132
6,431,853 B1 * 8/2002 Sher ..... 431/129

* cited by examiner

*Primary Examiner*—James C. Yeung
(74) *Attorney, Agent, or Firm*—Rosenberg, Klein & Lee

(57) ABSTRACT

A lighter includes a liquid gas container having an inside formed with a receiving space, a press member pivotally mounted on the liquid gas container, and a control member movably mounted in the receiving chamber of the press member. Thus, the slide knob has to proceed a substantially L-shaped movement to trigger the igniter and to light the lighter, so that the lighter cannot be operated easily and unintentionally, thereby providing a double safety effect. In addition, the control member is integrally formed with the slide knob and the locking flange, so that the slide knob co-operates with the locking flange to perform the locking and unlocking actions conveniently and actually, thereby enhancing operation of the safety switch structure of the lighter.

12 Claims, 10 Drawing Sheets

LIGHTER HAVING A SAFETY SWITCH

CROSS-REFERENCES TO RELATED APPLICATIONS

The present invention is a continuation-in-part application of the U.S. Ser. No. 10/139,258, filed on May 7, 2002 U.S. Pat. No. 6,551,097.

BACKGROUND OF THE INVENTION

1. Field of the Invention

The present invention relates to a lighter having a double safety switch, and more particularly to a lighter that cannot be operated easily and unintentionally, thereby providing a double safety effect.

2. Description of the Related Art

A conventional lighter in accordance with the prior art is disclosed in the applicant's U.S. Pat. No. 6,231,335B 1. However, the conventional press type lighter disclosed in the applicant's U.S. Pat. No. 6,231,335B1 has a complicated construction with many parts, thereby increasing costs of fabrication.

Another conventional lighter in accordance with the prior art is disclosed in U.S. Pat. No. 6,431,853B1 to Sher. In the Sher reference, the lobe 75 is pressed downward to lift the member 90, thereby unlocking the safety switch. Thus, the safety switch is released by a vertical movement. Thus, the safety switch is easily unlocked by pressing the lobe 75 successively.

A further conventional lighter in accordance with the prior art is disclosed in U.S. Pat. No. 6,135,761 to Chen.

SUMMARY OF THE INVENTION

The present invention has arisen to mitigate and/or obviate the disadvantage of the conventional lighter.

The primary objective of the present invention is to provide a lighter having a safety switch, wherein the slide knob has to proceed a substantially L-shaped movement to trigger the igniter and to light the lighter, so that the lighter cannot be operated easily and unintentionally, thereby providing a double safety effect.

Another objective of the present invention is to provide a lighter having a safety switch having a simple construction, thereby saving cost of fabrication.

A further objective of the present invention is to provide a lighter, wherein the control member is integrally formed with the slide knob and the locking flange, so that the slide knob co-operates with the locking flange to perform the locking and unlocking actions conveniently and actually, thereby enhancing operation of the safety switch structure of the lighter.

In accordance with the present invention, there is provided a lighter, comprising:

a liquid gas container having an inside formed with a receiving space;

a press member pivotally mounted on the liquid gas container, and having a first side pivotally mounted in the receiving space of the liquid gas container and a second side having a bottom formed with a locking hole, the press member having a top formed with a receiving chamber which has an inner wall provided with a guide rail; and a control member mounted in the receiving chamber of the press member and including a guide plate slidably mounted on the guide rail of the receiving chamber of the press member, the control member including a leg portion integrally formed on a bottom of the guide plate, the leg portion of the control member having a bottom formed with a protruding locking flange which is locked in the locking hole of the press member and is rested on a top edge of the receiving space of the liquid gas container, the locking flange of the control member having a top rested on a wall of the locking hole of the press member and a bottom rested on the top edge of the receiving space of the liquid gas container, so that the press member is locked on the top edge of the receiving space of the liquid gas container by the locking flange of the control member;

wherein, the locking flange of the control member and the locking hole of the press member form a first-stage safety switch structure.

Further benefits and advantages of the present invention will become apparent after a careful reading of the detailed description with appropriate reference to the accompanying drawings.

DETAILED DESCRIPTION OF THE INVENTION

Figure 1:
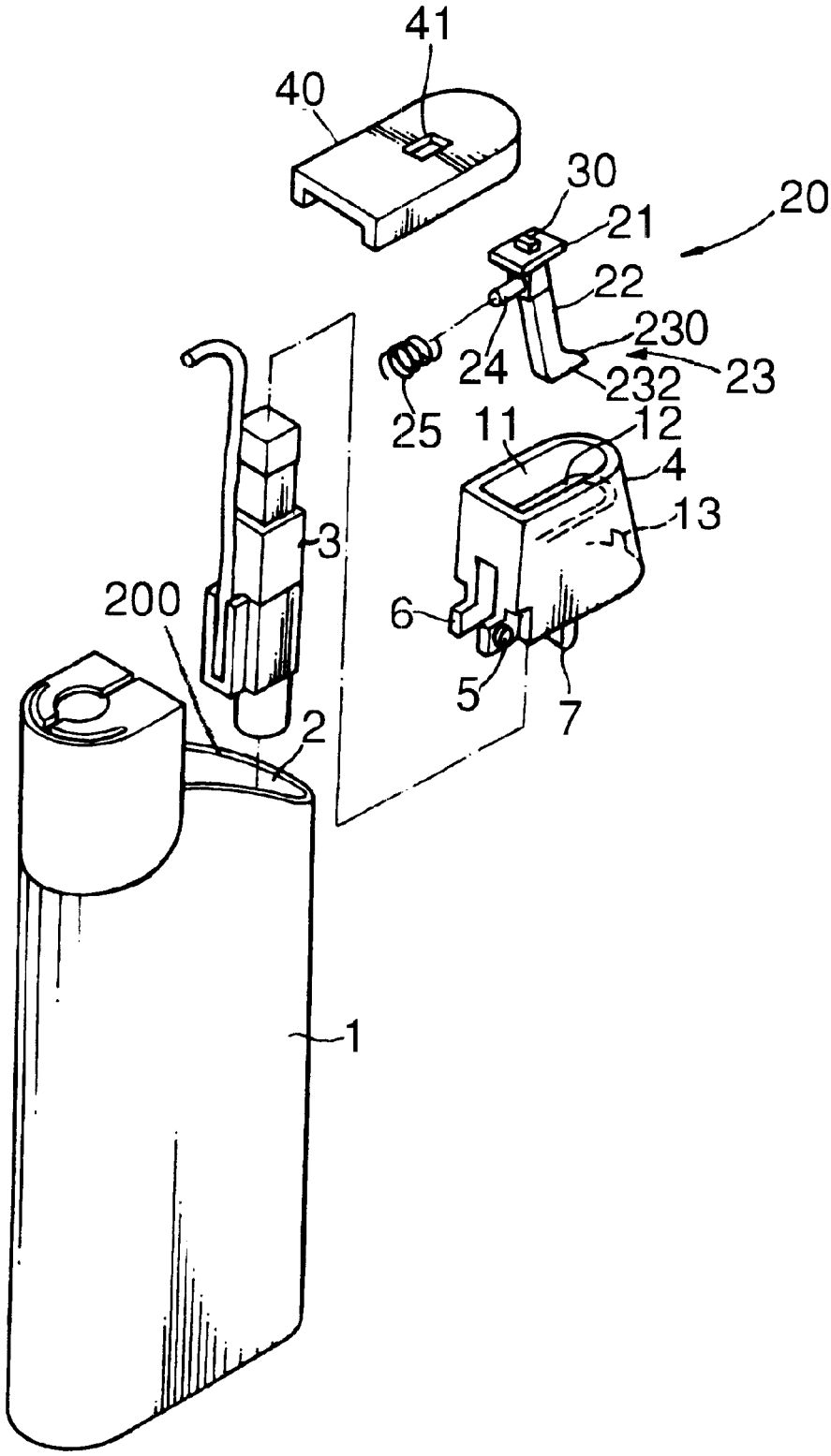
FIG. 1 is an exploded perspective view of a lighter having a safety switch in accordance with a first embodiment of the present invention.
Figure 2:
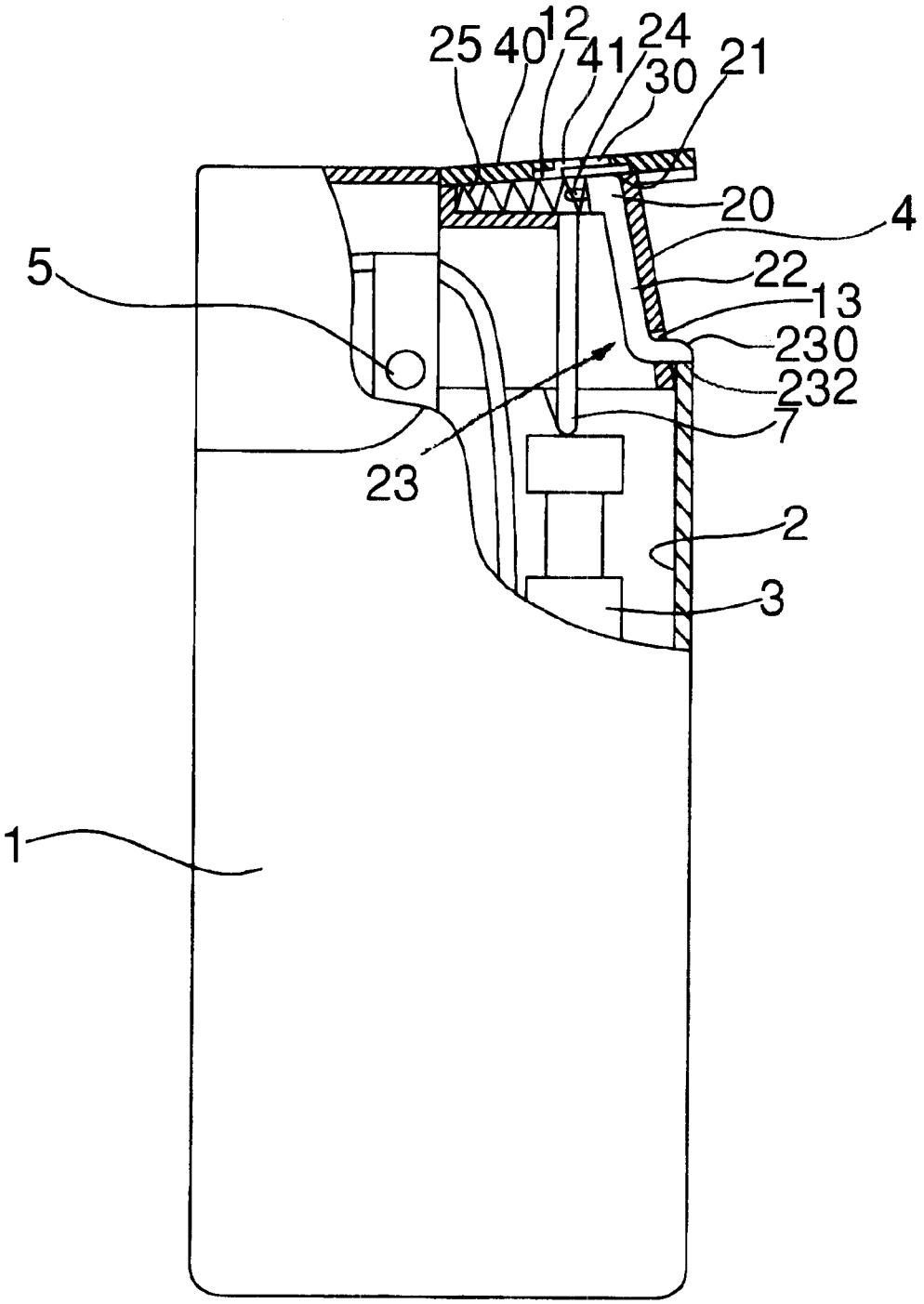
FIG. 2 is a side plan partially cross-sectional assembly view of the lighter having a safety switch as shown in FIG. 1.
Figure 3:
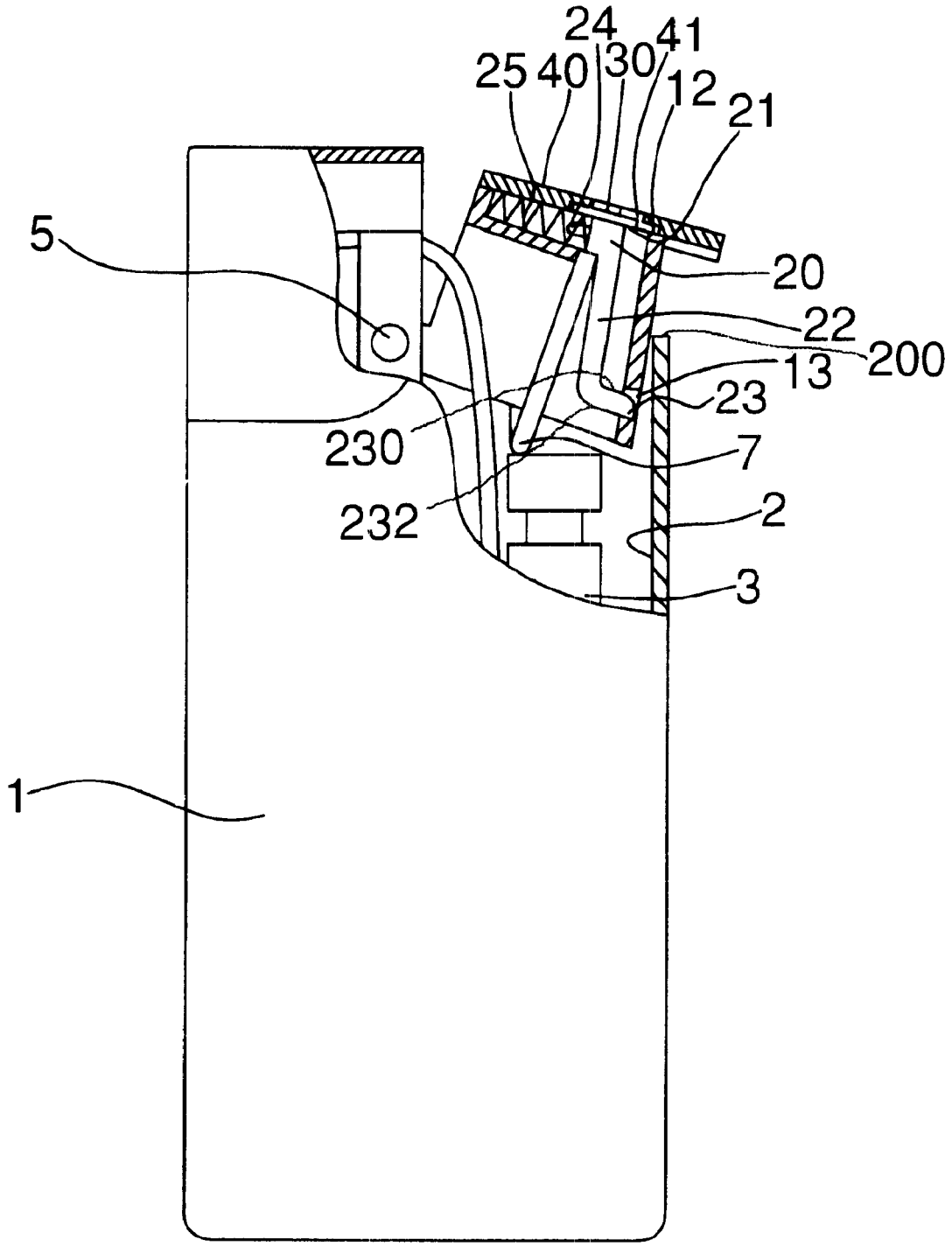
FIG. 3 is a schematic operational view of the lighter having a safety switch as shown in FIG. 2 in use.
Figure 4:
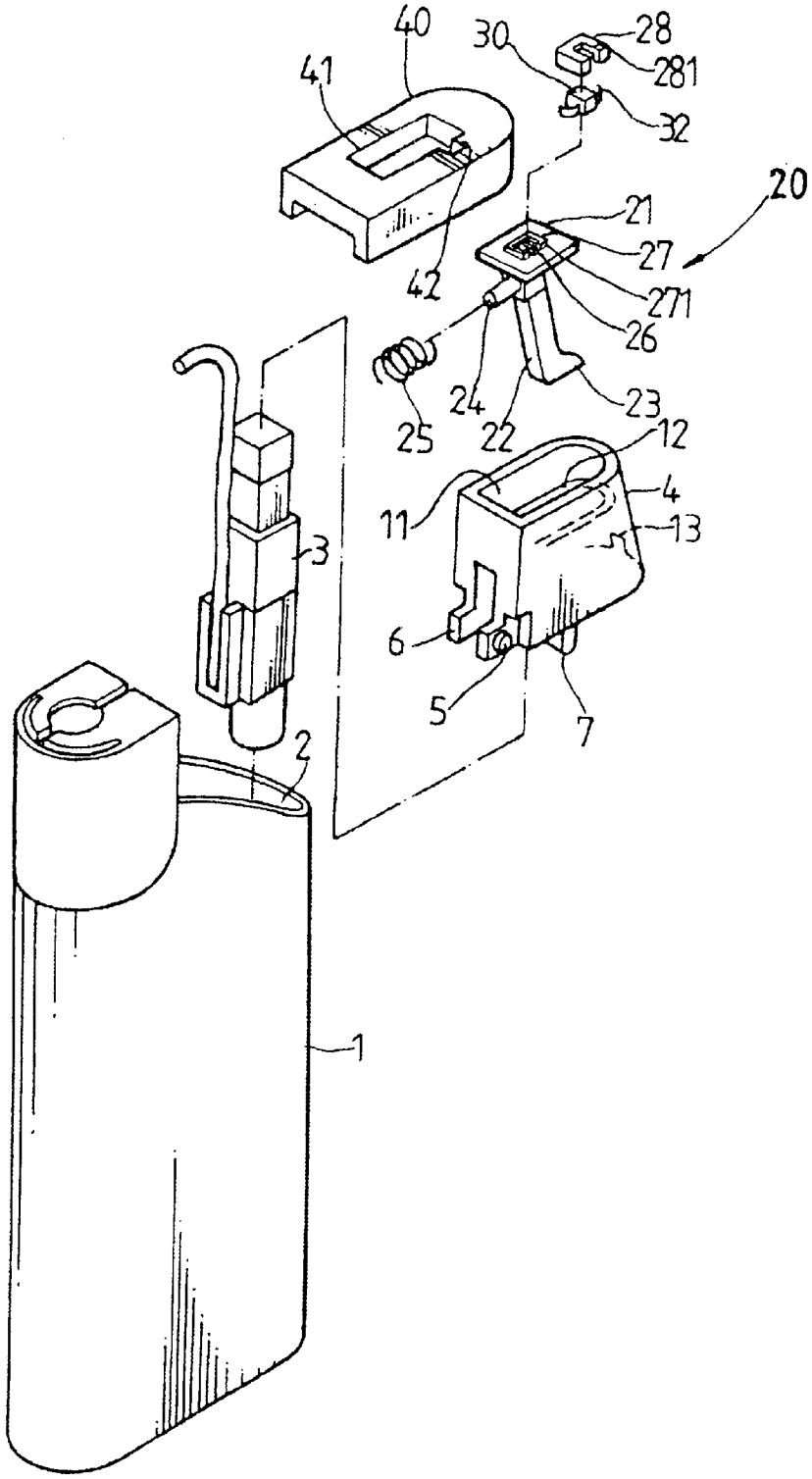
FIG. 4 is an exploded perspective view of a lighter having a safety switch in accordance with a second embodiment of the present invention.
Figure 5:
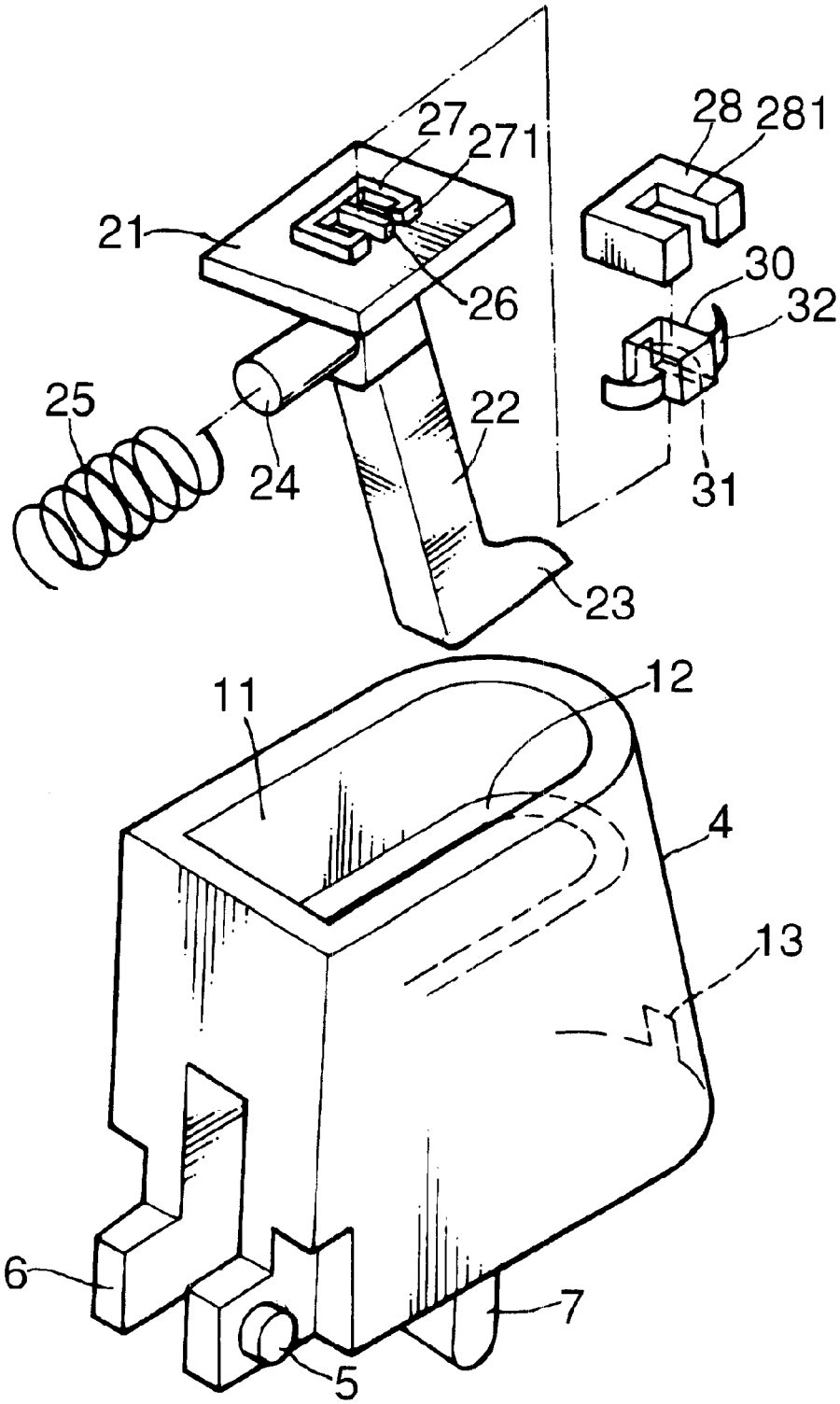
FIG. 5 is a partially exploded perspective view of the lighter having a safety switch in accordance with the second embodiment of the present invention.
Figure 6:
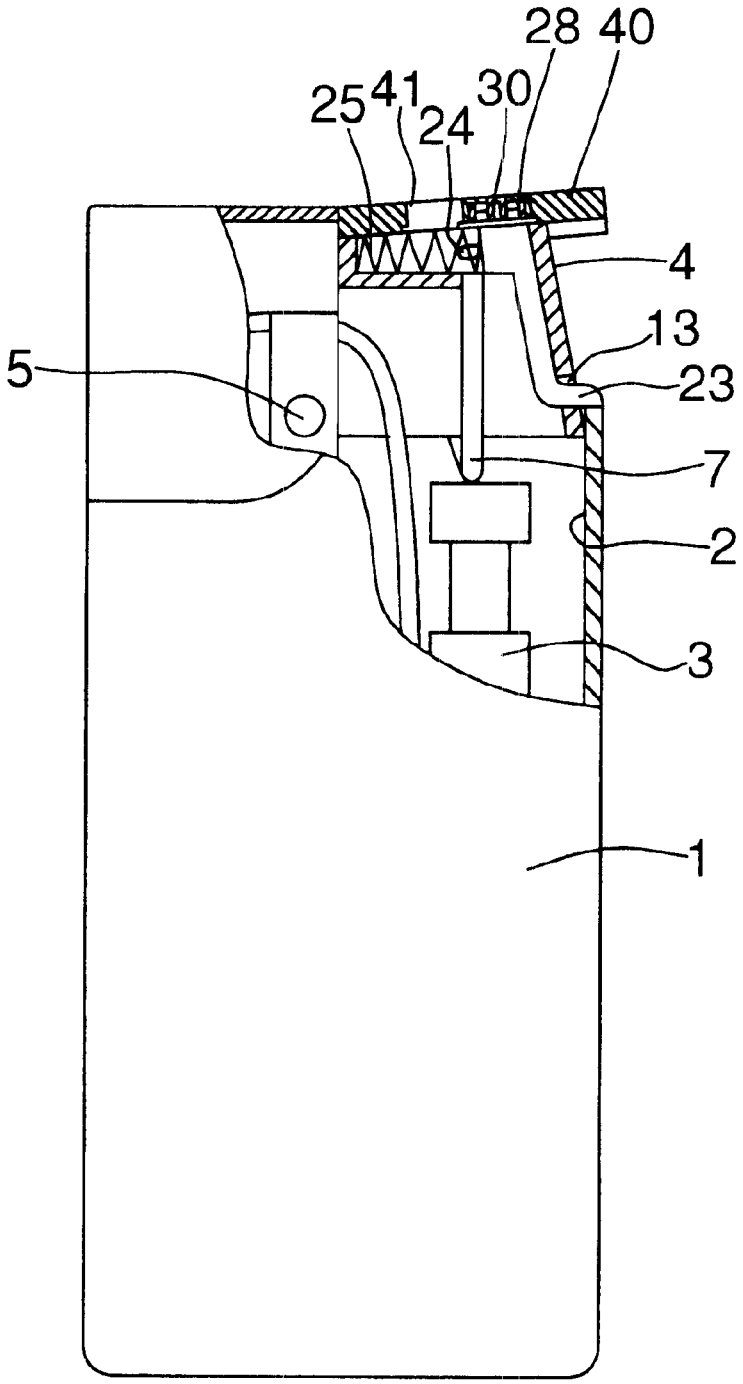
FIG. 6 is a side plan partially cross-sectional assembly view of the lighter having a safety switch as shown in FIG. 4.

Referring to the drawings and initially to FIGS. 1–3, a press type lighter having a safety switch in accordance with a first embodiment of the present invention comprises a liquid gas container 1, an igniter 3, a press member 4, a control member 20, a slide knob 30, and a top cover 40.

The liquid gas container 1 has an inside formed with a receiving space 2.

The igniter 3 is mounted in the receiving space 2 of the liquid gas container 1.

The press member 4 is pivotally mounted in the receiving space 2 of the liquid gas container 1. The press member 4 has a first side having a bottom provided with a pivot shaft 5 pivotally mounted in the receiving space 2, so that the press member 4 is pivoted in the receiving space 2 of the liquid gas container 1 by pivoting the pivot shaft 5. The pivot shaft 5 is provided with a forked bar 6 which is connected to a gas valve (not shown). The press member 4 has a bottom provided with a trigger 7 which is rested on the igniter 3.

Thus, when the user exerts a downward pressure on the press member 4, the press member 4 is pivoted about the pivot shaft 5, so that the forked bar 6 is moved to operate the gas valve and the trigger 7 is moved to trigger the igniter 3, so that the lighter is lighted conveniently.

The press member 4 has a top formed with a receiving chamber 11 which has an inner wall provided with a guide rail 12. The press member 4 has a second side having a bottom formed with a locking hole 13.

The control member 20 is movably mounted in the receiving chamber 11 of the press member 4, and includes a guide plate 21 slidably mounted on the guide rail 12 of the receiving chamber 11 of the press member 4. The control member 20 includes a leg portion 22 integrally formed on a bottom of the guide plate 21. The leg portion 22 of the control member 20 has a bottom formed with a protruding locking flange 23 which is locked in the locking hole 13 of the press member 4 and is rested on a top edge 200 of the receiving space 2 of the liquid gas container 1.

Preferably, the locking flange 23 of the leg portion 22 of the control member 20 has a top 230 rested on a wall of the locking hole 13 of the press member 4 and a bottom 232 rested on the top edge 200 of the receiving space 2 of the liquid gas container 1, so that the press member 4 is locked on the top edge 200 of the receiving space 2 of the liquid gas container 1 by the locking flange 23 of the control member 20.

Thus, the press member 4 is locked on the top edge 200 of the receiving space 2 of the liquid gas container 1 and cannot be pressed downward, thereby preventing the press member 4 from being pivoted to trigger the igniter 3 and to light the lighter, so that the liquid gas container 1 is disposed at an actually locking state.

The leg portion 22 of the control member 20 is integrally formed with a guide rod 24 for mounting an elastic member 25 which is pressed between the inner wall of the press member 4 and the leg portion 22 of the control member 20, to press the leg portion 22 and the locking flange 23 of the control member 20 to pass through the locking hole 13 of the press member 4, so that the press member 4 is locked on the top edge 200 of the receiving space 2 of the liquid gas container 1 by the locking flange 23 of the control member 20.

The slide knob 30 is integrally formed on a top of the guide plate 21 of the control member 20, so that when the slide knob 30 is moved, the guide plate 21 of the control member 20 is moved with the slide knob 30.

The top cover 40 is secured on the top of the press member 4, and is formed with a guide slot 41 to receive the slide knob 30, so that the slide knob 30 is slidable in the guide slot 41 of the top cover 40.

In operation, the locking flange 23 of the control member 20 is initially locked in the locking hole 13 of the press member 4, with the top 230 of the locking flange 23 of the leg portion 22 being rested on the wall of the locking hole 13 of the press member 4 and with the bottom 232 of the locking flange 23 of the leg portion 22 being rested on the top edge 200 of the receiving space 2 of the liquid gas container 1 as shown in FIG. 2, so that the press member 4 is locked on the top edge 200 of the receiving space 2 of the liquid gas container 1 and cannot be pressed downward, thereby preventing the press member 4 from being pivoted to trigger the igniter 3 and to light the lighter, so that the liquid gas container 1 is disposed at an actually locking state.

Alternatively, the slide knob 30 is pushed by the user to overcome the elastic force of the elastic member 25 to slide in the guide slot 41 of the top cover 40 so as to move from the position as shown in FIG. 2 to the position as shown in FIG. 3, thereby detaching the locking flange 23 of the control member 20 from the wall of the locking hole 13 of the press member 4 and the top edge 200 of the receiving space 2 of the liquid gas container 1, so that when the press member 4 is pressed downward, the press member 4 is pivoted about the pivot shaft 5 to move the trigger 7 to trigger the igniter 3 and to light the lighter, so that the liquid gas container 1 is disposed at an unlocking state.

Accordingly, the slide knob 30 and the locking flange 23 of the control member 20 co-operate with each other to form the first-stage safety switch structure so as to lock the press member 4 on the top edge 200 of the receiving space 2 of the liquid gas container 1 rigidly and stably.

Thus, the user needs to push and move the slide knob 30 to detach the locking flange 23 of the control member 20 from the wall of the locking hole 13 of the press member 4 and the top edge 200 of the receiving space 2 of the liquid gas container 1, so as to trigger the igniter 3 and to light the lighter, so that the lighter cannot be operated easily and unintentionally, thereby providing a safety effect. In addition, the press type lighter having a safety switch in accordance with the present invention has a simple construction, thereby saving cost of fabrication. Further, the control member 20 is integrally formed with the slide knob 30 and the locking flange 23, so that the slide knob 30 co-operates with the locking flange 23 to perform the locking and unlocking actions conveniently and actually, thereby enhancing operation of the safety switch structure of the lighter.

Referring to FIGS. 4–8, a press type lighter having a safety switch in accordance with a second embodiment of the present invention further comprises a second-stage safety switch structure mounted between the slide knob 30, the control member 20 and the top cover 40.

The second-stage safety switch structure includes a locking recess 42 formed in the guide slot 41 of the top cover 40, so that the locking recess 42 and the guide slot 41 of the top cover 40 form a substantially L-shaped structure. The slide knob 30 is locked in the locking recess 42 temporarily. Thus, when the slide knob 30 is pushed, the slide knob 30 is moved in the locking recess 42 into the guide slot 41 of the top cover 40.

The control member 20 includes a locking rail 26 integrally formed on the top of the guide plate 21. The slide knob 30 has a bottom formed with a channel 31 to receive the locking rail 26 of the control member 20, so that the slide knob 30 is slidable in the locking recess 42 by guidance of the locking rail 26 of the control member 20 to move into the guide slot 41 of the top cover 40.

The control member 20 includes a substantially inverted U-shaped positioning block 27 integrally formed on the top of the guide plate 21 and enclosed around the locking rail 26, to enhance stability of movement of the slide knob 30. The positioning block 27 has two distal ends each formed with a hook portion 271 located beside the locking rail 26. The control member 20 includes an inner cover 28 mounted on the positioning block 27 to cover the slide knob 30. The inner cover 28 is formed with a channel 281. The slide knob 30 is protruded outward from the channel 281 of the inner cover 28 into the locking recess 42.

The slide knob 30 has two sides each provided with a wing-shaped elastic member 32 which is rested on the positioning block 27, so that the slide knob 30 is pushed by the two wing-shaped elastic members 32 to move toward the locking recess 42 and is locked in the locking recess 42.

Figure 7:
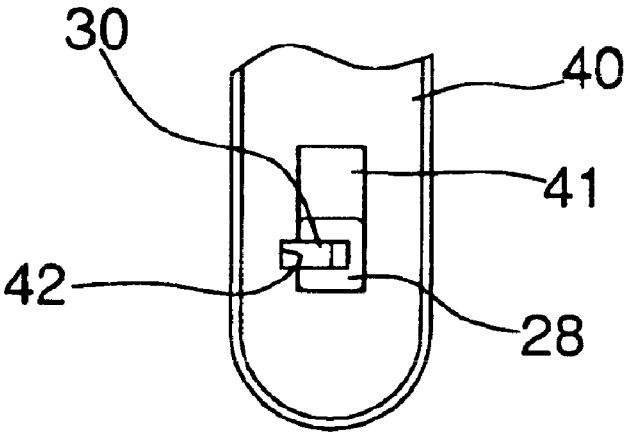
FIG. 7 is a top plan partially cut-away assembly view of the lighter having a safety switch as shown in FIG. 4.

In operation, the slide knob 30 is initially locked in the locking recess 42 as shown in FIG. 7. Then, the slide knob 30 is pushed to overcome the elastic force of the two wing-shaped elastic members 32 to slide in the locking recess 42 so as to move from the position as shown in FIG. 7 to the position as shown in FIG. 9 where the slide knob 30 is detached from the locking recess 42 and is moved into the guide slot 41 of the top cover 40, so that the slide knob 30 is slidable in the guide slot 41 of the top cover 40 freely.

Figure 8:
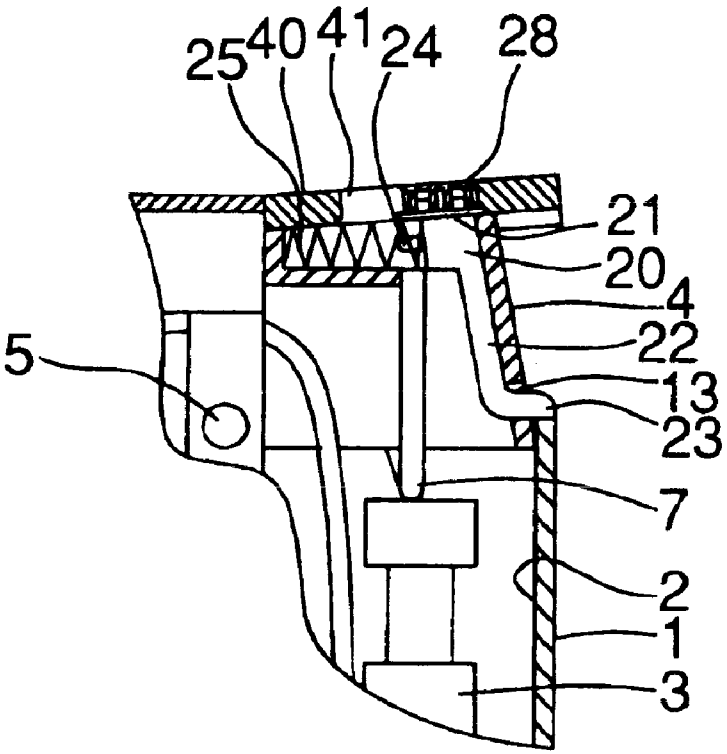
FIG. 8 is a partially enlarged view of the lighter having a safety switch as shown in FIG. 6.

At the same time, the locking flange 23 of the control member 20 is locked in the locking hole 13 of the press member 4, with the top 230 of the locking flange 23 of the leg portion 22 being rested on the wall of the locking hole 13 of the press member 4 and with the bottom 232 of the locking flange 23 of the leg portion 22 being rested on the top edge 200 of the receiving space 2 of the liquid gas container 1 as shown in FIG. 8, so that the press member 4 is locked on the top edge 200 of the receiving space 2 of the liquid gas container 1 and cannot be pressed downward, thereby preventing the press member 4 from being pivoted to trigger the igniter 3 and to light the lighter, so that the liquid gas container 1 is disposed at an actually locking state.

Figure 9:
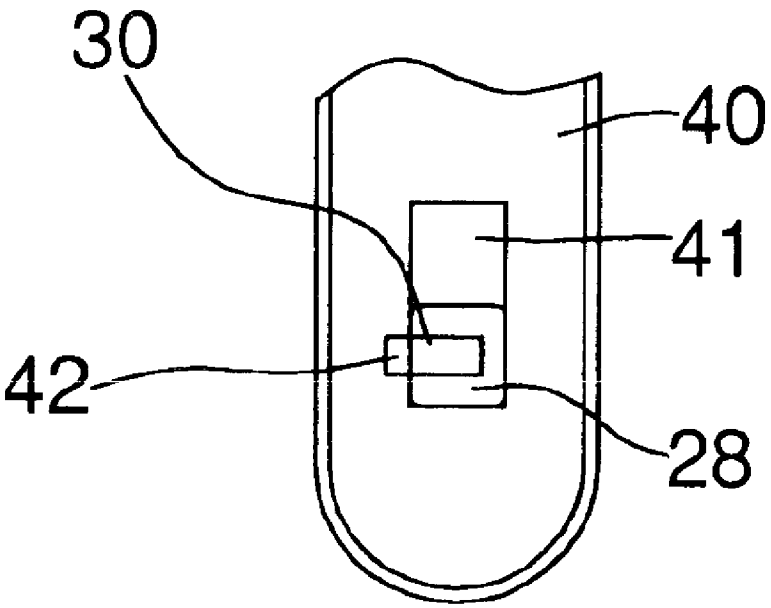
FIG. 9 is a schematic operational view of the lighter having a safety switch as shown in FIG. 7 in use.
Figure 11:
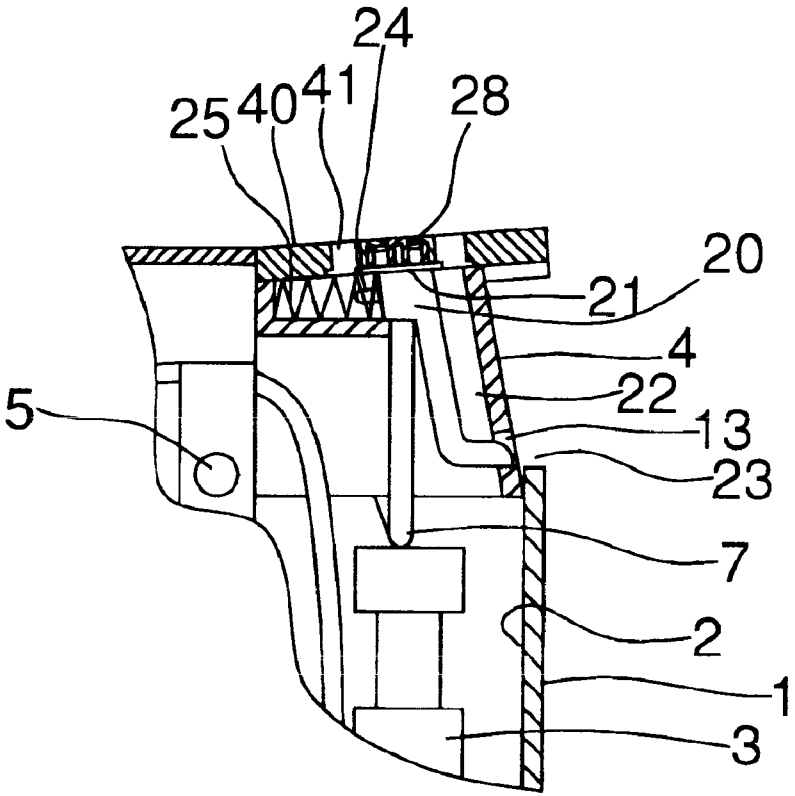
FIG. 11 is a schematic operational view of the lighter having a safety switch as shown in FIG. 8 in use.
Figure 10:
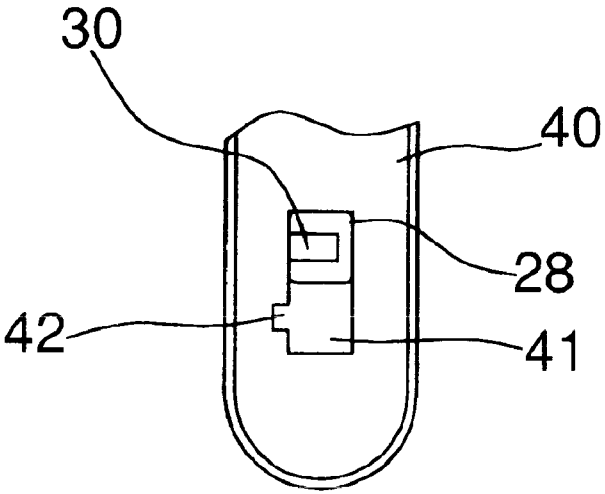
FIG. 10 is a schematic operational view of the lighter having a safety switch as shown in FIG. 9 in use.
Figure 12:
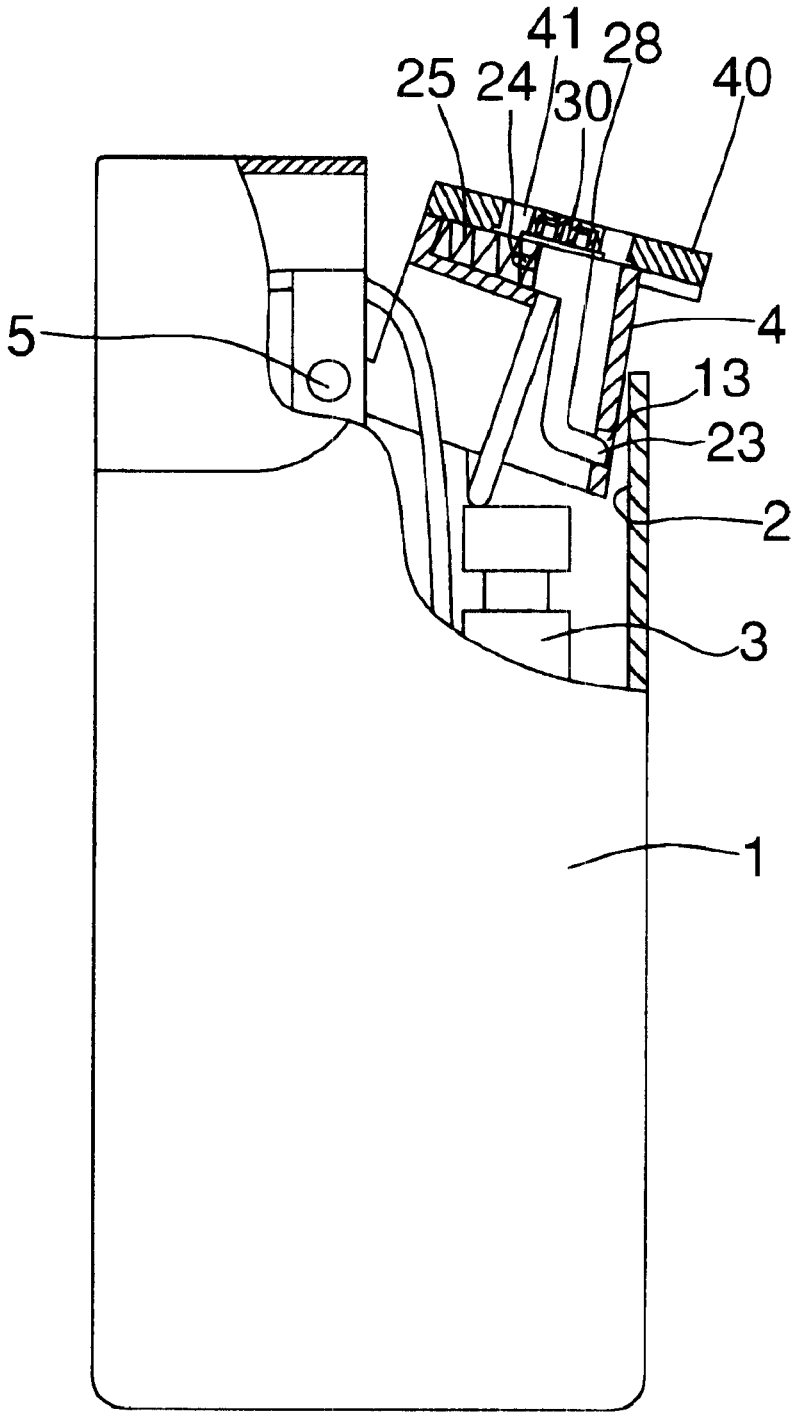
FIG. 12 is a schematic operational view of the lighter having a safety switch as shown in FIG. 11 in use.

Then, the slide knob 30 is pushed to overcome the elastic force of the elastic member 25 to slide in the guide slot 41 of the top cover 40 so as to move from the position as shown in FIGS. 8 and 9 to the position as shown in FIGS. 10 and 11, thereby detaching the locking flange 23 of the control member 20 from the wall of the locking hole 13 of the press member 4 and the top edge of the receiving space 2 of the liquid gas container 1, so that when the press member 4 is pressed downward as shown in FIG. 12, and the press member 4 is pivoted about the pivot shaft 5 to move the trigger 7 to trigger the igniter 3 and to light the lighter, so that the liquid gas container 1 is disposed at an unlocking state.

Accordingly, the second-stage safety switch structure is mounted between the slide knob 30, the control member 20 and the top cover 40. Thus, the slide knob 30 has to proceed a substantially L-shaped movement so as to trigger the igniter 3 and to light the lighter, so that the lighter cannot be operated easily and unintentionally, thereby providing a double safety effect. In addition, the press type lighter having a safety switch in accordance with the present invention has a simple construction, thereby saving cost of fabrication.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lighter, comprising:

a liquid gas container having an inside formed with a receiving space;

a press member pivotally mounted on the liquid gas container, and having a first side pivotally mounted in the receiving space of the liquid gas container and a second side having a bottom formed with a locking hole, the press member having a top formed with a receiving chamber which has an inner wall provided with a guide rail; and a control member mounted in the receiving chamber of the press member and including a guide plate slidably mounted on the guide rail of the receiving chamber of the press member, the control member including a leg portion integrally formed on a bottom of the guide plate, the leg portion of the control member having a bottom formed with a protruding locking flange which is locked in the locking hole of the press member and is rested on a top edge of the receiving space of the liquid gas container, the locking flange of the control member having a top rested on a wall of the locking hole of the press member and a bottom rested on the top edge of the receiving space of the liquid gas container, so that the press member is locked on the top edge of the receiving space of the liquid gas container by the locking flange of the control member;

wherein, the locking flange of the control member and the locking hole of the press member form a first-stage safety switch structure.

2. The lighter in accordance with claim 1, wherein the control member is integrally formed with the locking flange.

3. The lighter in accordance with claim 1, wherein the control member includes an elastic member mounted between an inner wall of the press member and the leg portion of the control member to press the locking flange of the control member to be locked in the locking hole of the press member.

4. The lighter in accordance with claim 3, wherein the leg portion of the control member is formed with a guide rod, and the elastic member is mounted on the guide rod of the leg portion of the control member.

5. The lighter in accordance with claim 1, further comprising a slide knob secured on a top of the guide plate of the control member.

6. The lighter in accordance with claim 5, wherein the control member is integrally formed with the locking flange and the slide knob.

7. The lighter in accordance with claim 5, further comprising a top cover secured on the top of the press member, and formed with a guide slot to receive the slide knob, so that the slide knob is slidable in the guide slot of the top cover.

8. The lighter in accordance with claim 7, further comprising a second-stage safety switch structure including a locking recess formed in the guide slot of the top cover, so that the locking recess and the guide slot of the top cover form a substantially L-shaped structure.

9. The lighter in accordance with claim 8, wherein the top of the guide plate of the control member is provided with a locking rail, the slide knob is slidably mounted in the locking recess, and has a bottom formed with a channel to receive the locking rail of the control member, so that the slide knob is slidable in the locking recess by guidance of the locking rail of the control member to move into the guide slot of the top cover.

10. The lighter in accordance with claim 9, wherein the top of the guide plate of the control member is provided with a substantially inverted U-shaped positioning block enclosed around the locking rail and having two distal ends each formed with a hook portion located beside the locking rail, and an inner cover mounted on the positioning block to cover the slide knob.

11. The lighter in accordance with claim 10, wherein the inner cover is formed with a channel, and the slide knob is protruded outward from the channel of the inner cover into the locking recess.

12. The lighter in accordance with claim 10, wherein the slide knob has two sides each provided with a wing-shaped elastic member which is rested on the positioning block, so that the slide knob is pushed by the wing-shaped elastic member to move toward the locking recess.

* * * * *